US007568299B2

(12) United States Patent
Denha

(10) Patent No.: US 7,568,299 B2
(45) Date of Patent: Aug. 4, 2009

(54) SHOE INSERT

(76) Inventor: Souhayla M. Denha, 204 Charing Cross Ct., Bloomfield Hills, MI (US) 48304

( * ) Notice: Subject to any disclaimer, the term of this patent is extended or adjusted under 35 U.S.C. 154(b) by 435 days.

(21) Appl. No.: 11/371,712

(22) Filed: Mar. 9, 2006

(65) Prior Publication Data

US 2007/0209237 A1 Sep. 13, 2007

(51) Int. Cl.
*A43B 19/00* (2006.01)

(52) U.S. Cl. ..... 36/71

(58) Field of Classification Search ..... 36/71, 36/43, 44, 93

See application file for complete search history.

(56) References Cited

U.S. PATENT DOCUMENTS

| | | | | |
|---|---|---|---|---|
| 2,732,065 | A * | 1/1956 | Marchese | 36/59 R |
| 2,917,846 | A * | 12/1959 | Scholl | 36/145 |
| 3,693,270 | A * | 9/1972 | Murray | 36/58.5 |
| 3,749,091 | A | 7/1973 | Basa | |
| 3,837,026 | A | 9/1974 | White | |
| 3,852,897 | A | 12/1974 | Bridge et al. | |
| 4,026,046 | A | 5/1977 | Clark et al. | |
| 4,054,706 | A | 10/1977 | Shapiro | |
| 4,185,402 | A | 1/1980 | Digate | |
| 5,740,618 | A * | 4/1998 | Minden | 36/8.3 |
| 6,082,027 | A | 7/2000 | Wagonhurst | |
| 6,270,872 | B1 * | 8/2001 | Cline et al. | 428/40.1 |
| 6,442,875 | B1 | 9/2002 | Joubert et al. | |
| 6,618,962 | B1 | 9/2003 | Covatch | |
| 6,694,648 | B2 | 2/2004 | Eriksen | |
| 2001/0003876 | A1 | 6/2001 | Racine | |
| 2002/0083622 | A1 | 7/2002 | Joubert et al. | |
| 2004/0025377 | A1 * | 2/2004 | Brannon | 36/59 R |
| 2004/0159018 | A1 | 8/2004 | Meibock | |
| 2006/0265903 | A1 * | 11/2006 | Strong | 36/25 R |

* cited by examiner

*Primary Examiner*—Ted Kavanaugh
(74) *Attorney, Agent, or Firm*—Brooks Kushman, P.C.

(57) ABSTRACT

A shoe insert (10) which includes a sheet-like pad (12). The pad (12) defines an upper surface (18) and a lower surface (20) and has a generally pointed shape for insertion into an front foot portion (16) of footwear such as a shoe (15) or like. The upper surface (18) has an adhesive (22) which secures the pad (12) to an upper inner surface (24) of the front foot portion (16) of footwear. The lower surface (20) cushions the front foot portion (16) to provide comfort to a person wearing the shoe (15).

14 Claims, 1 Drawing Sheet

SHOE INSERT

BACKGROUND OF THE INVENTION

1. Field of the Invention

This invention relates to a shoe insert for the upper inner portion of footwear.

2. Background Art

Articles of footwear vary in form and function, and include varieties such as dress shoes, causal shoes, athletic shoes, dance shoes, work shoes, snow shoes, boots, sandals, and swim fins. Articles of footwear are typically mass-produced according to specific dimensions and construction specifications. The dimensions and specifications are usually designed to fit an average anatomically-shaped foot of a particular size. However, little consideration has been give to the biomechanics and unique anatomical variations among feet of different users.

A foot is a very complex biomechanical body part which creates special challenges for people seeking footwear that is both proper-fitting and comfortable. The foot has bones, cartilage and muscles which together create an intricate biomechanical structure. Each footwear user has a foot of unique biomechanical structure which has made protecting a toe area of the foot an increasing challenge. Toe protectors have been used in pre-assembled footwear such as roller skakes, in-line skating, ice skating, skiing, steel-toed boots, dance slippers, etc. However, toe protectors of prior footwear are manufactured according to pre-defined product specifications and do not accommodate the unique biomechanical and anatomical variations of each footwear user. Shoe comfort and fit is largely a subjective determination which greatly depends on the personal preferences of each footwear user. Despite attempts of prior art, the biomechanics and unique anatomical variations among feet of different users create a need for a footwear insert that cushions a front foot portion of a person wearing an article of footwear.

Prior art patents include U.S. Pat. Nos. 6,694,648; 6,618,962; 6,442,875; 6,270,872; 6,082,027; 4,026,046; 3,837,026; and 3,749,091; and U.S. Published Patent Application Nos. 2004/0159018A1; 2002/0083622; and 2001/0003876.

SUMMARY OF THE INVENTION

An object of the present invention is to provide a footwear insert for cushioning a front foot portion of a person wearing an article of footwear such as a shoe, boot, slipper, or the like.

The footwear insert of the present invention includes a sheet-like pad. The pad defines an upper surface and a lower surface and has a generally pointed shape for insertion into the front foot portion of footwear. The upper surface has an adhesive which secures the pad to an upper inner surface of the front foot portion of footwear. The lower surface cushions the front foot portion to provide comfort to a person wearing the shoe.

In the preferred construction of the footwear insert, the pad is made of foam. The pad may be injection-molded foam, such as polyurethane foam. The pad may have a generally triangular shape including curved vertices to facilitate insertion and securement of the insert in the shoe.

In the preferred construction of the footwear insert, the lower surface of the pad may have one or more cut lines to facilitate cutting of the pad to a smaller size. The cut lines may be curved and have an intermediate portion extending between ends thereof and located forwardly toward the pointed front end of the pad. The cut lines provide ease of cutting of the pad to one of a selected number of smaller sizes.

Furthermore, the cut lines reduce the pad thickness, which reduces the amount of shear force necessary to cut the pad to a smaller size. Additionally, the cut lines provide a visual aid to facilitate symmetrical cutting of the insert.

In the preferred construction of the footwear insert, the upper surface has a removable backing layer covering the adhesive. After the backing layer is removed from the adhesive, the insert is inserted into the shoe and secured to the upper inner surface of the front foot portion of footwear. The backing layer is disclosed as including a tear line to facilitate removal of the backing layer.

The objects, features and advantages of the present invention are readily apparent from the following detailed description of the preferred embodiment when taken in connection with the accompanying drawings.

DETAILED DESCRIPTION OF THE PREFERRED EMBODIMENT

Figure 1:
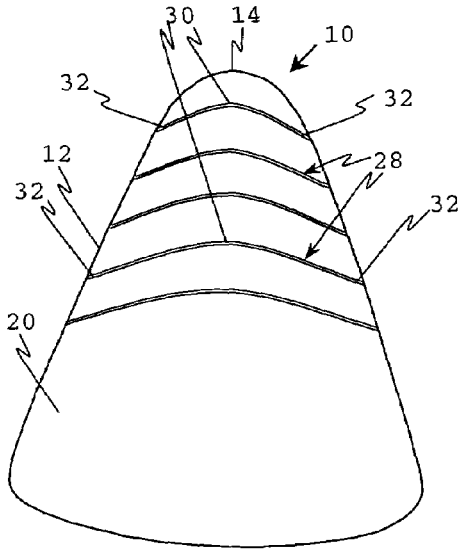
FIG. 1 is a bottom view illustrating a shoe insert constructed in accordance with the present invention and showing a lower surface of the insert.
Figure 2:
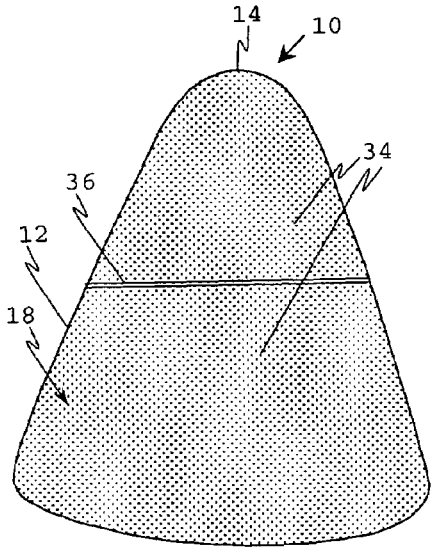
FIG. 2 is a top view illustrating an upper surface of the shoe insert which includes a backing layer having a tear line.

With reference to FIGS. 1-4, a shoe insert 10 constructed in accordance with the present invention includes a sheet-like pad 12. The pad 12 defines an upper surface 18 and a lower surface 20 and has a generally pointed shape including a front end 14 for insertion into a front foot portion 16 of footwear such as a shoe 15 or like. The upper surface includes an adhesive 22 which secures the pad 12 to an upper inner surface 24 of the front foot portion 16 of the footwear. The lower surface 20 cushions the front foot portion 16 to provide comfort to a person wearing the shoe 15.

With continuing reference to FIGS. 1-4, the pad 12 of the footwear insert 10 may be made of foam and may be injection-molded foam such as polyurethane foam. As shown, the pad may have a generally triangular shape including curved vertices to facilitate insertion and securement of the insert 12 in the shoe 15.

With continuing reference to FIGS. 1-4, the lower surface 20 of the pad 12 may have one or more cut lines 28 to facilitate cutting of the pad 12 to a smaller size. The cut lines 28 are shown as curved and each has an intermediate portion 30 extending between its ends 32 and located forwardly toward the pointed front end 14 of the pad 12. The cut lines 28 provide ease of cutting of the pad 12 to one of a selected number of smaller sizes. Furthermore, the cut lines 28 reduce the pad thickness to facilitate cutting of the pad 12. Also, the cut lines 28 provide a visual aid to facilitate symmetrical cutting of the insert 10.

With continuing reference to FIGS. 1-4, the upper surface 18 of the footwear insert 10 may have a removable backing layer 34 covering the adhesive 22. After the backing layer 34 is removed from the adhesive 22, the insert 10 is inserted into the shoe 15 and secured to the upper inner surface 24 of the front foot portion 16 of footwear. The backing layer 34 includes a tear line 36 to facilitate removal of the backing layer 34 from the adhesive 22.

Figure 4:
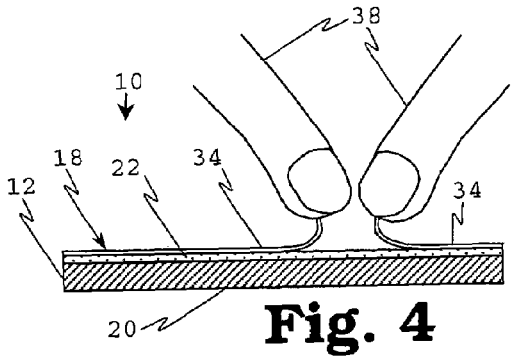
FIG. 4 is a sectional view through the shoe insert and illustrating the manner in which the backing layer is removed from adhesive on the upper surface.
Figure 3:
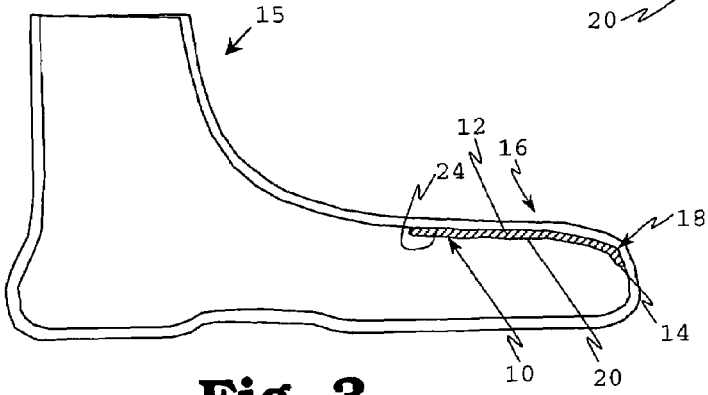
FIG. 3 is a vertical sectional view showing the shoe insert secured within a shoe.

FIG. 4 illustrates fingers 38 peeling the backing layer 34 away from the tear line 36 to removal the backing layer 34 from the adhesive 22.

While one embodiment of the invention has been illustrated and described, it is not intended that this embodiment illustrates and describes all possible forms of the invention. Rather, the words used in the specification are words of description rather than limitation, and it is understood that various changes may be made without departing from the spirit and scope of the invention.

What is claimed is:

1. A footwear insert comprising:

a sheet-like pad made of foam and having a generally triangular and pointed shape including curved vertices to facilitate insertion of the pad into a front foot portion of a shoe or like;

the pad including an upper surface having an adhesive to facilitate securing the pad to an upper inner surface of the front foot portion; and the pad having a lower surface to facilitate cushioning the upper front foot portion of a person wearing the shoe or like, the lower surface including at least one cut line to facilitate cutting of the pad to a smaller size.

2. The footwear insert as in claim 1 wherein the at least one cut line is curved and has an intermediate portion extending between ends thereof and located forwardly toward the pointed shape of the pad.

3. The footwear insert as in claim 1 wherein the lower surface of the pad has a plurality of spaced cut lines to facilitate cutting of the pad to one of a selected number of smaller sizes.

4. The footwear insert as in claim 3 wherein the plurality of spaced cut lines are curved and each has an intermediate portion extending between ends thereof and located forwardly toward the pointed shape of the pad.

5. The footwear insert as in claim 1 wherein the upper surface includes a backing layer that contacts the adhesive and is removable therefrom prior to insertion of the pad into the shoe.

6. The footwear insert as in claim 5 wherein the backing layer includes a tear line to facilitate removal of the backing layer from the adhesive.

7. A footwear insert comprising:

a generally triangular shaped sheet-like injection molded pad made of polyurethane foam and having a generally pointed shape and curved vertices to facilitate insertion of the pad into a front foot portion of a shoe or like;

the pad having an upper surface including an adhesive to facilitate securing the pad to an upper inner surface of the front portion;

a backing layer that initially covers the adhesive prior to insertion of the pad into the front portion, and the backing layer having a tear line to facilitate removal of the backing layer from the adhesive so that the adhesive can secure the pad to an upper inner surface of the front foot portion of the shoe;

the pad having a lower surface to facilitate cushioning the upper front foot portion of a person wearing the shoe and including a plurality of spaced cut lines to facilitate cutting of the pad to one of a selected number of smaller sizes; and the plurality of spaced cut lines being curved and each having an intermediate portion extending between ends thereof and located forwardly toward the pointed shape of the pad.

8. The footwear insert of claim 7 wherein the curved vertices facilitate securement of the pad into the front foot portion of the shoe or like.

9. The footwear insert of claim 7 wherein the spaced cut lines reduce thickness of the lower surface of the pad to facilitate cutting of the pad.

10. The footwear insert of claim 7 wherein the spaced cut lines reduce thickness of the lower surface of the pad as well as a shear force necessary to cut the pad to a smaller size.

11. The footwear insert of claim 7 wherein the spaced cut lines provide a visual aid to facilitate symmetrical cutting of the pad.

12. The footwear insert of claim 7 wherein the backing layer is configured to peel away from the tear line to remove the backing layer from the adhesive.

13. The footwear insert of claim 7 wherein the curved vertices facilitate securement of the pad into the front foot portion of the shoe or like, the spaced cut lines providing a visual aid to facilitate symmetrical cutting of the pad as well as reducing thickness of the pad to reduce the shear force needed to cut the pad.

14. The footwear insert of claim 1 wherein the curved vertices facilitate securement of the pad into the front foot portion of the shoe or like, the cut line providing a visual aid to facilitate symmetrical cutting of the pad as well as reducing thickness of the pad to reduce the shear force needed to cut the pad.

* * * * *

UNITED STATES PATENT AND TRADEMARK OFFICE

CERTIFICATE OF CORRECTION

PATENT NO. : 7,568,299 B2
APPLICATION NO. : 11/371712
DATED : August 4, 2009
INVENTOR(S) : Souhayla M. Denha It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 583 days.

Signed and Sealed this

Seventh Day of September, 2010

David J. Kappos

David J. Kappos
*Director of the United States Patent and Trademark Office*